US005178262A

United States Patent [19]

Merkli et al.

[11] Patent Number: 5,178,262

[45] Date of Patent: Jan. 12, 1993

[54] SHEET TRANSPORTING TONGS FOR USE IN CHAIN CONVEYORS AND THE LIKE

[75] Inventors: Peter Merkli, Oftringen; Albert Eugster, Strengelbach; Jean-Claude Oppliger, Niederhasli, all of Switzerland

[73] Assignee: Grapha-Holding AG, Hergiswil, Switzerland

[21] Appl. No.: 720,772

[22] PCT Filed: Oct. 22, 1990

[86] PCT No.: PCT/90/00247
§ 371 Date: Jul. 8, 1991
§ 102(e) Date: Jul. 8, 1991

[87] PCT Pub. No. WO91/07342
PCT Pub. Date: May 30, 1991

[30] Foreign Application Priority Data

Nov. 8, 1989 [CH] Switzerland ..... 4023/89

[51] Int. Cl.[5] ..... B65G 47/86

[52] U.S. Cl. ..... 198/803.9; 198/470.1; 271/204

[58] Field of Search ..... 198/803.9, 470.1; 294/104, 116; 271/82, 85, 268, 272, 204, 205, 206

[56] References Cited

U.S. PATENT DOCUMENTS

| | | | |
|---|---|---|---|
| 2,940,750 | 6/1960 | Mestre | 270/58 |
| 3,902,750 | 9/1975 | Roitel | 294/104 X |
| 4,167,996 | 9/1979 | Cutter | 294/116 X |
| 4,381,056 | 4/1983 | Eberle | 271/204 X |
| 4,681,213 | 7/1987 | Winiasz | 198/803.9 |
| 4,921,294 | 5/1990 | Klopfenstein | 271/204 X |
| 4,968,081 | 11/1990 | Beight et al. | 198/470.1 X |
| 5,064,187 | 11/1991 | Müller | 198/803.9 X |

FOREIGN PATENT DOCUMENTS

| | | |
|---|---|---|
| 0241631 | 10/1987 | European Pat. Off. . |
| 0386442 | 9/1990 | European Pat. Off. . |
| 2822060 | 12/1978 | Fed. Rep. of Germany . |
| 2327181 | 5/1977 | France . |
| 0644816 | 8/1984 | Switzerland . |
| 0803027 | 10/1958 | United Kingdom . |

*Primary Examiner*—Robert P. Olszewski
*Assistant Examiner*—James R. Bidwell
*Attorney, Agent, or Firm*—Peter K. Kontler

[57] ABSTRACT

Tongs for releasably clamping newspapers or other sheet-like commodities for movement with a conveyor have a housing connectable to the conveyor, a first jaw provided on the housing, a second jaw which is pivotable in or on the housing between open and closed positions adjacent and remote from the first jaw, respectively, and a mechanism for pivoting the second jaw. The mechanism employs a lever which is pivotable relative to the housing with and with respect to the second jaw between first and second end positions which respectively correspond to the open and closed positions of the second jaw, one or more springs which oppose pivotal movements of the lever relative to the second jaw during pivoting of the lever to its second end position, and a motion transmitting unit which operates between the lever and the spring or springs and is caused to move through a dead-center position during each movement of the lever between its first and second end positions. The unit can comprise a toggle joint or a cam and cam follower.

13 Claims, 4 Drawing Sheets

SHEET TRANSPORTING TONGS FOR USE IN CHAIN CONVEYORS AND THE LIKE

BACKGROUND OF THE INVENTION

The present invention relates to clamping tongs for chain conveyors.

An apparatus of such character is known, for example, from Swiss Pat. No. 644,816. In this apparatus, retention of the movable clamping jaw in its closed position is effected by means of a pawl coupling. To this end, a ratchet wheel is non-rotatably connected with the movable clamping jaw. A spring-biased pawl, which is pivotable in the housing, engages the ratchet wheel in the locking position. The drawback of this apparatus is its complex design and also the fact that it is necessary to actuate two different levers in order to open and close the clamping tongs. A corresponding apparatus according to published European patent application No. 241,631, wherein a coil spring lock is provided in lieu of the pawl coupling, is not less complex regarding its design and its operation.

OBJECT OF THE INVENTION

An object of the present invention is to provide clamping tongs which can be used in chain conveyors of the aforementioned type and wherein locking of the movable clamping jaw in its closed position, as well as its opening, are effected by a simple mechanism without additional springs, actuating levers and other complex parts.

SUMMARY OF THE INVENTION

In accordance with the invention, this object is accomplished with the characteristic features of the patent claim 1.

The novel clamping tongs exhibit the advantage that, after having moved beyond the dead-center point of pivoting of the lever, the closing force of the springy force transmitting element which connects the lever with the movable clamping jaw locks the lever in that end position which corresponds to closed position of the movable clamping jaw. For such purpose, the dead-center mechanism for the lever requires only a small number of simple elements, for example, a discrete shaft for the lever as well as a toggle joint or a locking cam in combination with the lever.

DESCRIPTION OF PREFERRED EMBODIMENTS

Figure 1:
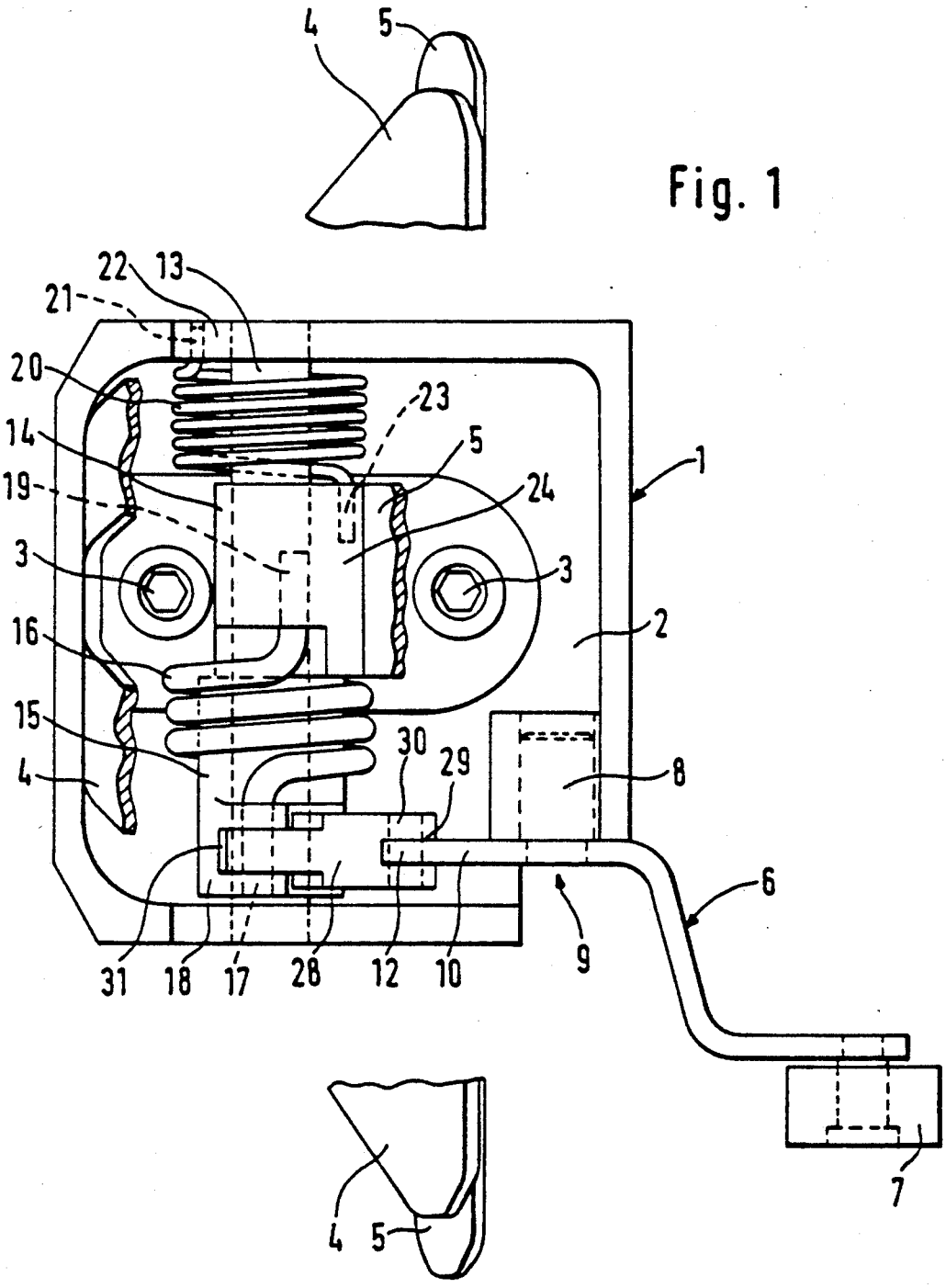
FIG. 1 a plan view of a first embodiment of the novel clamping tongs with a toggle joint, the clamping tongs being shown in the closed position.
Figure 2:
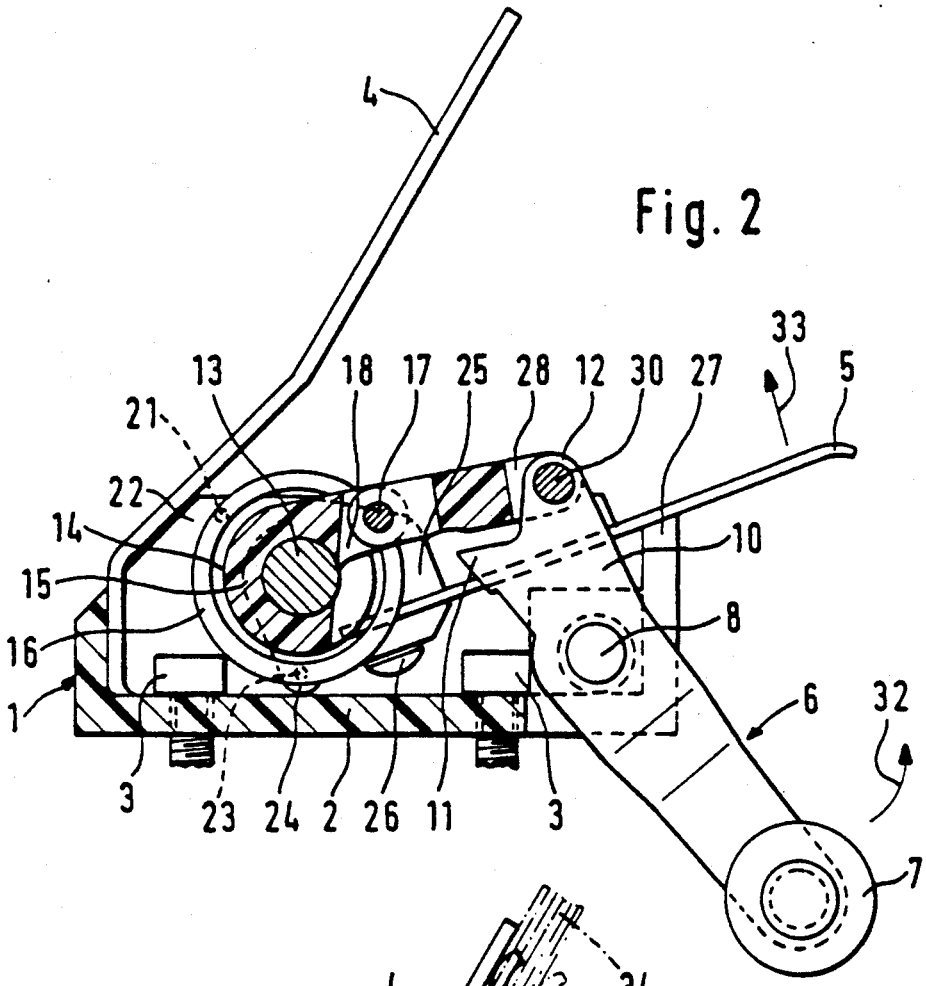
FIG. 2 a side elevational view, partly in section, of the clamping tongs of FIG. 1 but in their closed position.
Figure 3:
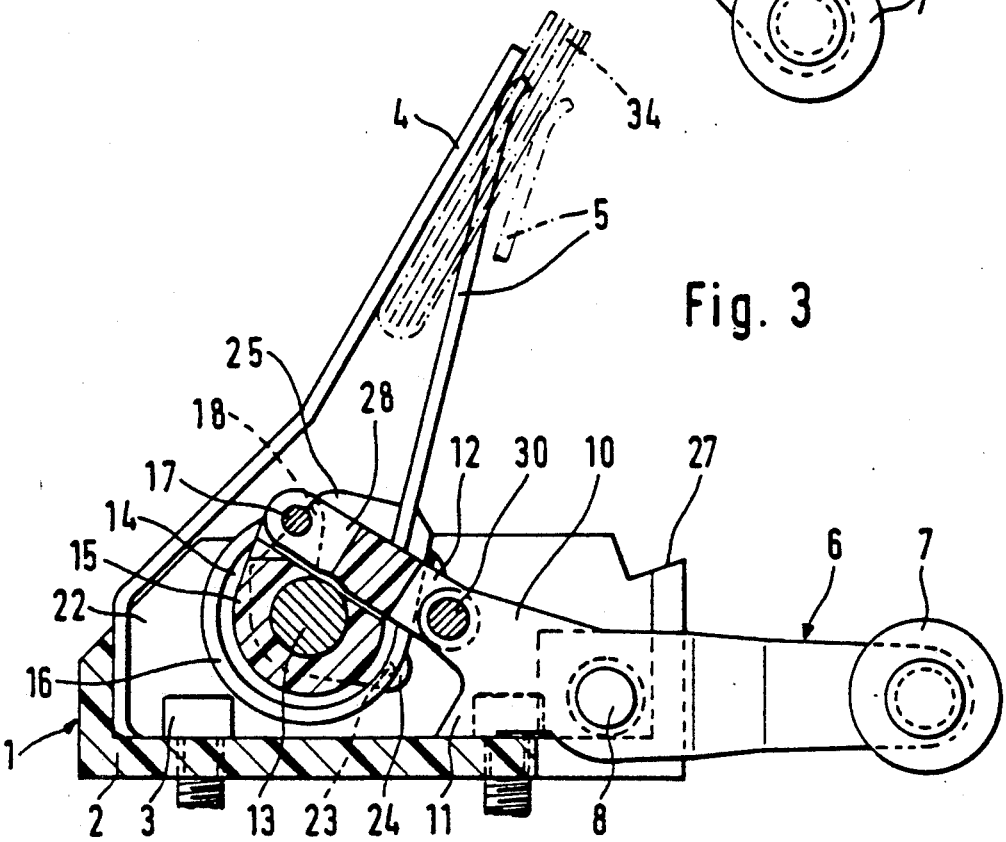
FIG. 3 a side elevational view, partly in section, of the clamping tongs of FIG. 1 in their closed position according to FIG. 1.

As shown in FIGS. 1 to 3, the illustrated clamping tongs comprise a substantially rectangular box-shaped housing 1 which is open at its upper side and consists of a plastic material. The external active elements of the clamping tongs are constituted by a clamping jaw 4 which is secured to the bottom 2 of the housing by screws 3, a pivotably movable clamping haw 5, and an actuating lever or actuator 6. The plate-like clamping jaws 4 and 5 are shown broken away in FIG. 1 for the sake of clarity. The screws 3 can simultaneously serve to secure the clamping tongs to a non-illustrated chain conveyor. In order to be actuatable by an external part, the lever 6 is provided with a roller 7.

The lever 6 is pivotably mounted on a shaft 8 which is disposed in the housing 1, namely in a corner recess 9 of the housing 1 (FIG. 1). The lever 6 has two arms and that arm 10 which is located opposite the roller 7 is provided with an extension 11 which abuts the inner side of the bottom 2 in the closed position of the clamping tongs (FIG. 3) to thus limit the pivotal movement of the lever 6 about the shaft 8 in one direction of pivotal movement and forms part of a motion transmitting unit. Furthermore, the arm 10 of the lever is provided with a nose 12 which has a bore.

The housing 1 further contains a bearing pin 13 which is parallel to the shaft 8. The bearing pin 13 carries a first sleeve-like part 14 which is rotatable thereon and, axially spaced apart from the sleeve-like part 14, a second sleeve-like part 15 which is rotatable on the bearing pin 13. The two sleeve-like parts 14 and 15, which can turn independently of each other, are connected to each other by a coaxial resilient force transmitting device here shown as a coil spring 16 (FIG. 1), one end 17 of the coil spring 16 being inserted into a nose 18 of the second sleeve-like part 15 and its other end 19 (FIG. 1) being inserted into the first sleeve-like part 14. In addition, there is provided on the bearing pin 13 a biasing means here shown as a second coaxial coil spring 20 which constitutes a restoring spring, one end 21 of which is inserted into a sidewall 22 of the housing 1 and the other end 23 of which is inserted into a nose 24 of the first sleeve-like part 14.

The movable clamping jaw 5 is fixedly anchored on a projection 25 of the first sleeve-like part 14 (FIGS. 2, 3) by means of screws 26 (FIG. 2). Thus, the jaw 5 is pivotable on the bearing pin 13 against the force of the coil spring 20 from the open position of FIG. 2 to the closed position of FIG. 3. The open position of the clamping jaw 5 is limited in that the clamping jaw 5 engages an upper marginal portion 27 (FIGS. 2, 3) of the housing.

The lever 6 is connected with the second sleeve-like part 15 by a link 28 of the motion transmitting unit, the nose 12 of the arm 10 of the lever being rotatably mounted in a slot 29 of the link 28 by a bolt 30. The other end of the link 28 is mounted in a slot 31 of the nose 18 of the second sleeve-like part 15 by one end 17 of the coil spring 16. Thus, an angular movement of the lever 6 brings about, by way of the link 28, a rotary movement of the second sleeve-like part 15 respectively a turning of the coil spring 16. The motion transmitting unit including the nose 12 and the link 28 is a toggle joint.

The sequence of movements and forces which develop in response to pivoting of the lever 6 can be described as follows.

When the clamping jaw 5 is in the open position of FIG. 2 in which, as already mentioned above, the clamping jaw 5 is biased against the marginal portion 27 of the housing by the restoring spring 20, the restoring spring 20 acts through the first sleeve-like part 14, by way of the first coil spring 16 and through the link 28 also upon the lever 6 and maintains the lever in the position which is shown in FIG. 2. Since, in this case, the lever 6 is free to move, the coil spring 16 can be said to constitute a quasi-rigid connection between the first sleeve-like part 14 and the lever 6.

If the lever 6 is then actuated in the direction of arrow 32 in FIG. 2, such pivotal movement is initially transmitted by the link 28 and coil spring 16 to the first sleeve-like part 14 also in the form of a quasi-rigid connection because such movement of the lever 6 must at first overcome only the counterforce of the second coil spring 20 the dimensions of which are considerably smaller than those of the first coil spring 16. In this manner, the movable clamping jaw 5 is pivoted toward the fixed clamping jaw 4 in the direction of arrow 33 in FIG. 2.

If, during its pivotal movement, the movable clamping jaw 5 engages a substantially rigid obstruction, which in accordance with FIG. 3 can either be the fixed clamping jaw 4 or an object, for example, a folded newspaper 34 (FIG. 3) which is located between the fixed and movable clamping jaws 4 respectively 5, the coil spring 16 is twisted in response to further pivoting of the lever 6 in the direction of arrow 32, namely the spring 16 is stressed, because the first sleeve-like part 14 can no longer turn. The counterforce which then acts upon the lever 6 is approximately equal to the force which the movable clamping jaw 5 exerts upon the fixed clamping jaw 4, either directly or by way of the object 34.

During such pivotal movement of the lever 6, the link 28 reaches a position in which the shaft 8 of the lever 6, the pin 30 in the arm 10 of the lever and the end 17 of the coil spring 16 are aligned, i.e., they establish a dead-center position. As soon as the lever 6 is pivoted further only slightly in the direction of arrow 32 (FIG. 2), the force of the coil spring 16 tends to automatically pivot the lever in such direction by way of the link 28. However, this is possible only for a small angular movement of the lever 6 because the extension 11 of the lever 6 comes into abutment with the bottom 2 of the housing 1. Thus, when in such position which is illustrated in FIG. 3, the lever 6 is arrested by the force of the stressed coil spring 16 on the one hand, and the movable clamping jaw 5 is biased against the fixed clamping jaw 4 (action=reaction). This result is achieved, without resorting to additional and complicated means, in a simple and advantageous manner in that, in accordance with the invention, the lever 6 is pivotable beyond the dead-center position because it does not act directly upon the coil spring 16 and hence upon the movable clamping jaw 5 but rather by way of the articulately connected link 28 which, together with the lever 6, constitutes a toggle joint.

In order to open the illustrated clamping tongs, the lever 6 is simply pivoted in a direction counter to that indicated by the arrow 32 whereby the coil spring 16 first opens the movable clamping jaw 5 and pushes the lever 6 downwardly, whereupon the restoring spring 20 takes care of complete opening inclusive of pivoting the lever 6 to its position of FIG. 2.

Figure 4:
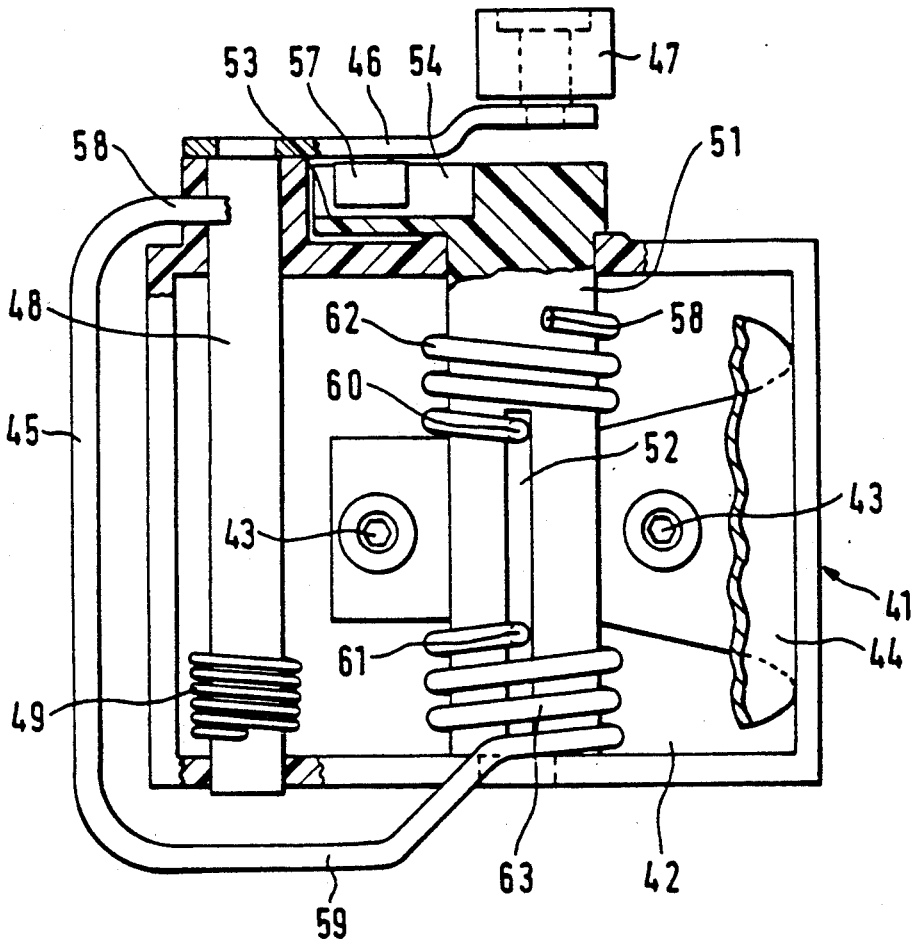
FIG. 4 a plan view, partly in section, of a second embodiment of the novel clamping tongs with a locking cam, the clamping tongs being shown in their closed position.
Figure 5:
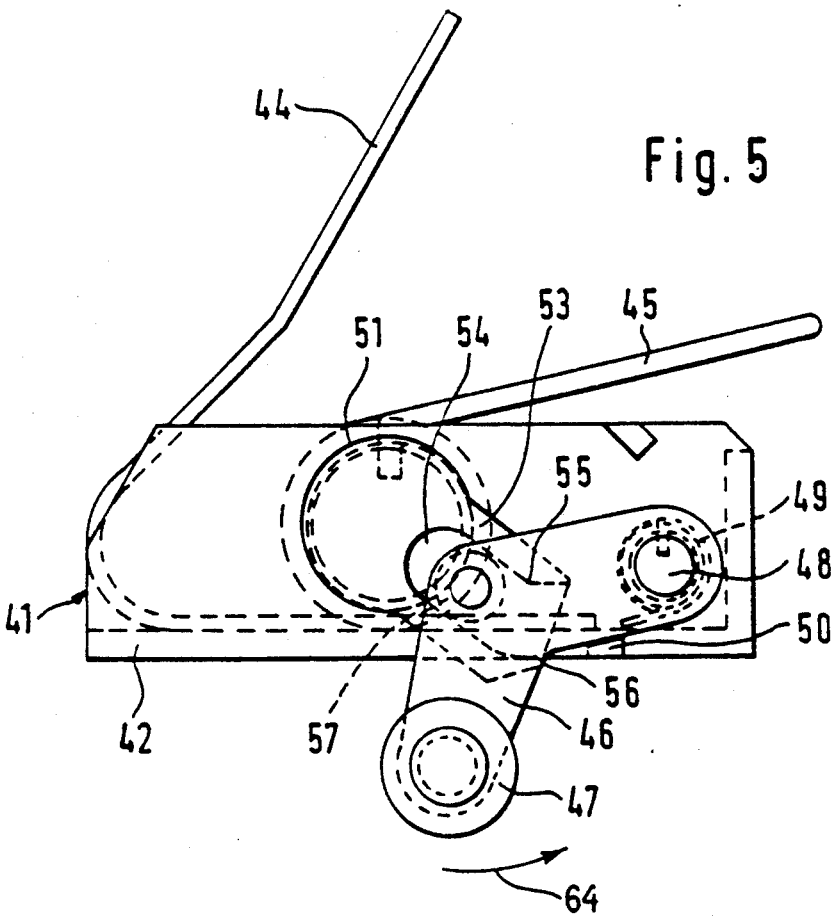
FIG. 5 a side elevational view of the clamping tongs of FIG. 4 but in their open position according to FIG. 4.
Figure 6:
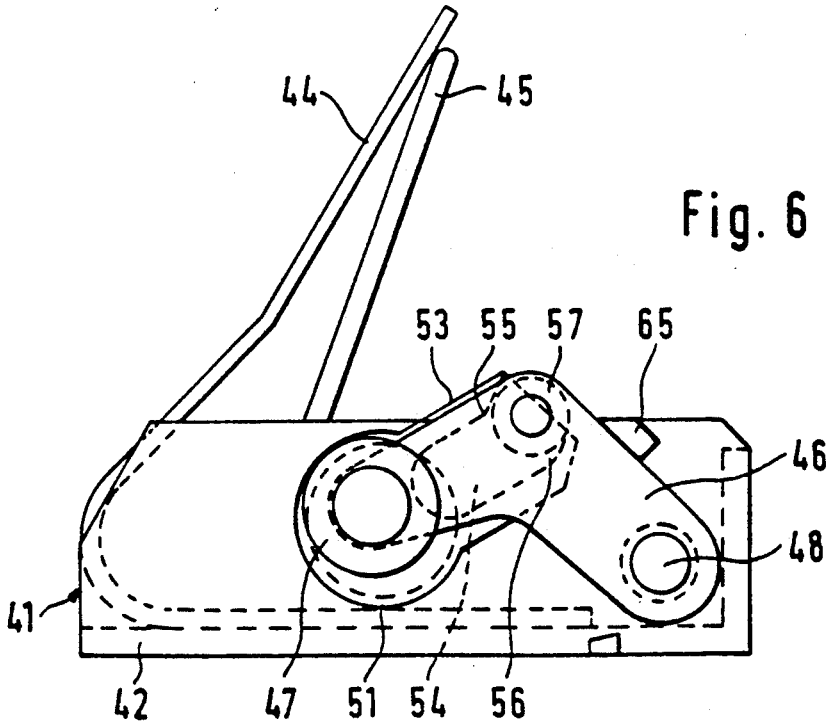
FIG. 6 a side elevational view of the clamping tongs of FIG. 4 in their closed position according to FIG. 1.

The further embodiment of the novel clamping tongs which is illustrated in FIGS. 4 to 6 employs another dead-center mechanism, namely a locking cam in lieu of a toggle joint.

The clamping tongs again comprise a substantially rectangular box-shaped housing 41 with a housing bottom 42 to which is affixed by means of screws 43 a clamping jaw 44 shown in FIG. 4 broken away. A pivotally movable clamping jaw 45, the configuration and mounting of which will be explained hereinafter, is constituted by a wire. Furthermore, for the purpose of actuation, the clamping tongs again comprise an actuator in the form of a lever 46 which is provided with a roller 47.

The lever 46 is connected with a first shaft 48 which is rotatably mounted in the housing 41 and is acted upon by the force of a coaxial biasing means in the form of a restoring spring 49 which reacts against the bottom 42 of the housing to thereby urge the lever 46, in the position which is shown in FIG. 5, against an abutment 50 of the housing.

A second shaft 51, which constitutes a hollow shaft and is made of a plastic material, the same as the housing 41, is also rotatably mounted in the housing 41. In the interior of the housing 41, the shaft 51 is provided with an elongated slot 52. The shaft 51 projects beyond one side of the housing 41 and is provided with an integral lever-like arm 53. The lever-like arm 53 has a radially outer end which is provided with an open straight longitudinal groove 54 the radially outer end region of which is provided with a bent portion 55 having a sharp edge at one side and a bend 56 (FIGS. 5, 6) at the other side. That side of the lever 46 which is located opposite the groove 54 is provided with a roller 57 which is guided in the recess 54. Thus, pivoting of the lever 46 entails a rotary movement of the shaft 51.

The wire-like movable clamping jaw 45, one lateral portion of which is broken away in FIG. 4 for the sake of clarity, has two lateral portions 58 and 59 which are convoluted around the shaft 51 in the interior of the housing 41 and the ends 60 respectively 61 of which are inserted into the slot 52 of the shaft 51. Thus, the convoluted sections of the movable clamping jaw 45 each constitute a coil spring 62 respectively 63 connecting the clamping jaw 45 with the lever 46 by way of the shaft 51 and the lever-like arm 53.

The mode of operation of the illustrated clamping tongs will be explained with reference to FIGS. 5, 6 as follows. As already explained, the restoring spring biases in FIG. 5 the lever 46 against the abutment 50 of the housing. In this manner, the clamping jaw 45 is maintained in the illustrated open position by the roller 57, groove 54 of the lever-like arm 53 and shaft 51 because, in the absence of any resistance on the part of the clamping jaw 45, the coil springs 62, 63 establish a quasi-rigid connection between the lever 46 and the clamping jaw 45.

If the lever 46 is thereupon pivoted by an external part in the direction of arrow 64, such pivotal movement is transmitted to the shaft 51 and hence to the clamping jaw 45 which, consequently, approaches the fixed clamping jaw 44. Only when the movable clamping jaw 45 encounters an obstruction, namely the fixed clamping jaw 44 respectively an object, such as a newspaper or the like, which is located between the two clamping jaws 44, 45 but is not shown in FIGS. 5 and 6, any further pivoting of the lever 46 in the direction of arrow 64 results in stressing of the two coil springs 62 and 63. Consequently, the clamping jaw 45 exerts a corresponding clamping force on the one hand whereas, on the other hand, the same force tends to restore the lever 46.

If the pivotal movement of the lever 46 is continued, there develops a situation in which the axis of the shaft 48, the axis of the roller 57 and the edge of the bent portion 55 of the groove 54 are in line, i.e., they assume a dead-center position, because the roller 57 is pressed against the edge of the bent portion 55. As soon as the lever 46 is pivoted only slightly further on in the direction of arrow 64, the force of the coil springs 62 and 63 tends to automatically move the lever 46 in such direction by way of the shaft 51, the lever-like arm 53 and the roller 57. However, this is possible only for a small angular movement of the lever 46, namely until the lever comes into engagement with a further abutment 65 of the housing 41, compare FIG. 6. Thus, the lever 46 is arrested in such position so that a certain clamping force acts between the clamping jaws 44 and 45. As in the previously described embodiment, opening of the clamping tongs is carried out in the reverse order.

We claim:

1. Tongs for releasably attaching paper sheets and like commodities to conveyors, comprising a housing; a first jaw on said housing; a second jaw supported by and movable relative to said housing between an open position remote from and a closed position adjacent said first jaw so that a commodity which is positioned between said jaws is clamped in the closed position of said second jaw; means for moving said second jaw between said positions including an actuator pivotably mounted on said housing for movement with and relative to said second jaw between a first end position corresponding to the open position of said second jaw and a second end position corresponding to the closed position of said second jaw, a resilient force transmitting device connected with said second jaw to oppose the movement of said actuator relative to said second jaw during movement of said actuator to said second end position, and a motion transmitting unit interposed between said device and said actuator and movable through a dead-center position during movement of said actuator between said end positions, said unit comprising a toggle joint and said toggle joint comprising a first portion articulately connected with said actuator and a second portion articulately connected with said device; and first and second shafts mounted in said housing and having substantially parallel axes, said actuator comprising a lever which is pivotable about the axis of said first shaft and said second jaw being pivotable about the axis of said second shaft, said device comprising a coil spring coaxial with said second shaft and having a torque transmitting first end portion connected to said second jaw and a second end portion constituting a fulcrum for the second portion of said link.

2. The tongs of claim 1, wherein said lever comprises a plurality of arms, said first portion of said link being articulately connected with one arm of said lever.

3. The tongs of claim 1, wherein said lever is rigid with said first shaft and said first shaft is rotatable in said housing about said first axis.

4. The tongs of claim 1, wherein said end portions of said spring are substantially parallel to said second axis.

5. The tongs of claim 1, further comprising means for biasing said second jaw to said open position and for simultaneously biasing said actuator to said first end position, said biasing means comprising a second coil spring bearing, against said second jaw and reacting against said housing.

6. The tongs of claim 1, further comprising means for biasing said second jaw and said actuator to said open position and to said first end position, respectively.

7. Tongs for releasably attaching paper sheets and like commodities to conveyors, comprising a housing; a first jaw on said housing, a second jaw supported by and movable relative to said housing between an open position remote from and a closed position adjacent said first jaw so that a commodity which is positioned between said jaws is clamped in the closed position of said second jaw; and means for moving said second jaw between said positions including an actuator pivotably mounted on said housing for movement with and relative to said second jaw between a first end position corresponding to the open position of said second jaw and a second end position corresponding to the closed position of said second jaw, a resilient force transmitting device connected with said second jaw to oppose the movement of said actuator relative to said second jaw during movement of said actuator to said second end position, and a motion transmitting unit interposed between said device and said actuator and movable through a dead-center position during movement of said actuator between said end positions, said unit comprising a cam member and a follower member tracking said cam member, one of said members being provided on said actuator and the other of said members being provided on said device.

8. The tongs of claim 7, wherein said cam member includes a groove and said follower member extends into said groove.

9. The tongs of claim 8, wherein said follower member includes a roller.

10. The tongs of claim 8, wherein said device comprises an arm which is pivotable in said housing and said groove is provided in said arm.

11. The tongs of claim 10, further comprising first and second shafts mounted in said housing and having substantially parallel axes, said actuator comprising a lever which is pivotable about the axis of said first shaft and said arm being pivotable about the axis of said second shaft.

12. The tongs of claim 11, wherein said first and second shafts are rotatable in said housing with said lever and said arm, respectively, said second jaw including a length of wire having two coil springs which are convoluted onto said second shaft in opposite directions and have end portions affixed to said second shaft.

13. The tongs of claim 11, further comprising means for biasing said second jaw and said actuator to said open position and to said first end position, respectively, said biasing means comprising a coil spring mounted on said first shaft, reacting against said housing and bearing upon said actuator.

* * * * *